United States Patent [19]

Anderka

[11] 4,382,707

[45] May 10, 1983

[54] FELT TIP WRITING PEN

[75] Inventor: Gerold Anderka, Ellerbek, Fed. Rep. of Germany

[73] Assignee: Koh-I-Noor Rapidograph, Inc., Bloomsbury, N.J.

[21] Appl. No.: 237,803

[22] Filed: Feb. 24, 1981

[30] Foreign Application Priority Data

Mar. 21, 1980 [DE] Fed. Rep. of Germany ..... 3010944

[51] Int. Cl.[3] ..... B43K 8/02

[52] U.S. Cl. ..... 401/198; 401/135; 401/229

[58] Field of Search ..... 401/198, 199, 135, 225–229

[56] References Cited

U.S. PATENT DOCUMENTS

| | | | |
|---|---|---|---|
| 2,620,774 | 12/1952 | Mustard | 120/50 |
| 2,685,273 | 8/1954 | Wing | 120/45.6 |
| 2,919,677 | 1/1960 | Mansheim | 120/45.4 |
| 2,935,967 | 5/1960 | Mansheim | 120/46 |
| 2,935,969 | 5/1960 | Kovacs | 401/226 |
| 3,442,597 | 5/1969 | Hebborn | 401/259 |
| 3,645,636 | 2/1972 | Mutschler | 401/133 |
| 3,900,268 | 8/1975 | Bok | 401/199 |
| 3,910,707 | 10/1975 | Gottschalk | 401/135 |
| 4,095,907 | 6/1978 | Kuparinen | 401/225 |
| 4,207,012 | 6/1980 | Kuparinen | 401/258 |
| 4,239,408 | 12/1980 | Mutschler | 401/217 |

FOREIGN PATENT DOCUMENTS

| | | | |
|---|---|---|---|
| 1224639 | 9/1966 | Fed. Rep. of Germany | 401/229 |
| 2405970 | 8/1974 | Fed. Rep. of Germany | 401/199 |
| 1967021 | 5/1976 | Fed. Rep. of Germany . | |
| 2948192 | 6/1980 | Fed. Rep. of Germany | 401/135 |
| 7903274 | 10/1980 | Netherlands | 401/198 |
| 899475 | 6/1962 | United Kingdom | 401/227 |

*Primary Examiner*—Clyde I. Coughenour

*Attorney, Agent, or Firm*—David H. Semmes; Warren E. Olsen

[57] ABSTRACT

Tubular writing pens of the stylographic type, particularly a felt tip pen. A cylindrical hollow body supports an ink reservoir at one end and a felt tip which extends from the ink reservoir through the front of the hollow body. The tubular body encompasses the writing element, while defining an inner pressure equalization chamber in its outer wall and a longitudinally extending axial groove in its inner wall, exposed throughout its length to the felt tip writing instrument. An intermediate cylindrical piece complementally engages the exterior wall of the cylindrical body, so as to cover the inner pressure equalization chamber and define in its exterior wall an outer pressure equalization chamber, communicant with the inner chamber. An outer sleeve complementally engages the intermediate piece, so as to cover the outer equalization chamber and define at its posterior end a reservoir seat. An ink reservoir cartridge may complementally engage the outer sleeve and the posterior end of the writing body, so as to communicate with the felt tip writing instrument.

5 Claims, 3 Drawing Figures

FELT TIP WRITING PEN

CROSS-REFERENCES TO RELATED APPLICATIONS

The present invention corresponds to West Germany P No. 30 10 944.5, filed Mar. 21, 1980, priority being claimed.

BACKGROUND OF THE INVENTION (1) Field of the Invention

Tubular writing instruments, particularly the felt tip type, wherein an annular expansion chamber is defined intermediate the felt tip and the ink reservoir, so as to admit expanding ink or an air bubble.

The present invention relates to a felt tip pen, of the type having a cylindrical body supporting a writing tip in its anterior end. The cylindrical body includes an interior bore whose posterior end is connected with an ink or writing fluid reservoir, communicating with the posterior end of the writing tip, since the posterior end of the writing tip extends directly into the reservoir. The cylindrical body includes in its anterior end both an inner pressure equalization chamber and an outer pressure equalization chamber. These chambers are superposed with respect to each other and are interconnecting at the posterior ends. The outer chamber includes an axial grove communicant with ambient air.

2. Description of the Prior Art

A known writing device of this type (West German - GMS No. 19 47 421), has the general form of a tubular felt tip writing pen, i.e., a writing tube supports a felt insert, as a writing tip. A type of fall weight is provided within the interior bore, so as to be axially reciprocable within limits, while rotating about its longitudinal axis. This creates an annular space inside the interior bore between the exterior wall and the fall weight, and at the posterior end of the interior bore and bore cross-section decreases and, correspondingly, also, the cross-section of the fall weight decreases. Due to the capillary characteristics of the annular space formed in this manner, there is presented a considerable resistance to the entrance of an air bubble from the inner pressure equalization chamber. In addition, the air bubble entering into the interior bore from the inner equalization chamber can also become lodged within the restricted annular space, particularly in the area with the reduced cross-section. Thus, on the one hand the equalization of pressure is made considerably more difficult and, on the other hand, the flow of ink or writing fluid from the ink reservoir to the writing tip may be blocked.

SUMMARY OF INVENTION

Therefore, it is an object of the present invention to improve a felt tip writing device of this type, in such a manner that an air bubble entering into the interior bore to equalize the pressure can move without significant impedance and without danger of becoming lodged in moving through the interior bore and into the ink reservoir.

A writing felt type pen of the aforementioned type is constructed according to the present invention, so that the interior bore along its entire axial length extends longitudinally beyond the connection with the inner equalization chamber. This inner equalization chamber does not have any decrease in cross-section. An axial groove extends in the exterior wall of the interior bore from the connection with the inner equalization chamber axially to the rear through the entire interior bore.

In a writing pen, constructed according to the present invention, the axial groove provided in the exterior wall of the interior bore provides a direct connection between the inner equalization chamber and the ink reservoir. Thus, an air bubble passing from the inner pressure equalization chamber into the interior bore moves without conventional impedance, such as may be caused by capillary forces, among other things, and thus moves, freely along the groove into the ink reservoir. The axial groove is constructed with a non-capillary cross-section, so that the air bubble may pass without difficulty and without danger of becoming lodged during movement between the interior bore and the ink reservoir. The cross-section of the interior bore does not diminish and, therefore, there is nothing blocking the movement of the air bubble.

To avoid a diversion of the air bubble when transferring from the inner pressure equalization chamber into the axial groove, which can inhibit further movement of the air bubble, the anterior end of the groove ends, preferably, within the inner equalization chamber. The axial groove has, preferably, a rectangular or square cross-section.

As the inner pressure equalization chamber extends from the front to the back meandering in a known manner, the exterior surfaces of the groove wall extend essentially radially to delimit, respectively, pairs of flow paths defined by the inner equalization chamber and extending radially.

DESCRIPTION OF THE PREFERRED EMBODIMENTS

Figure 1:
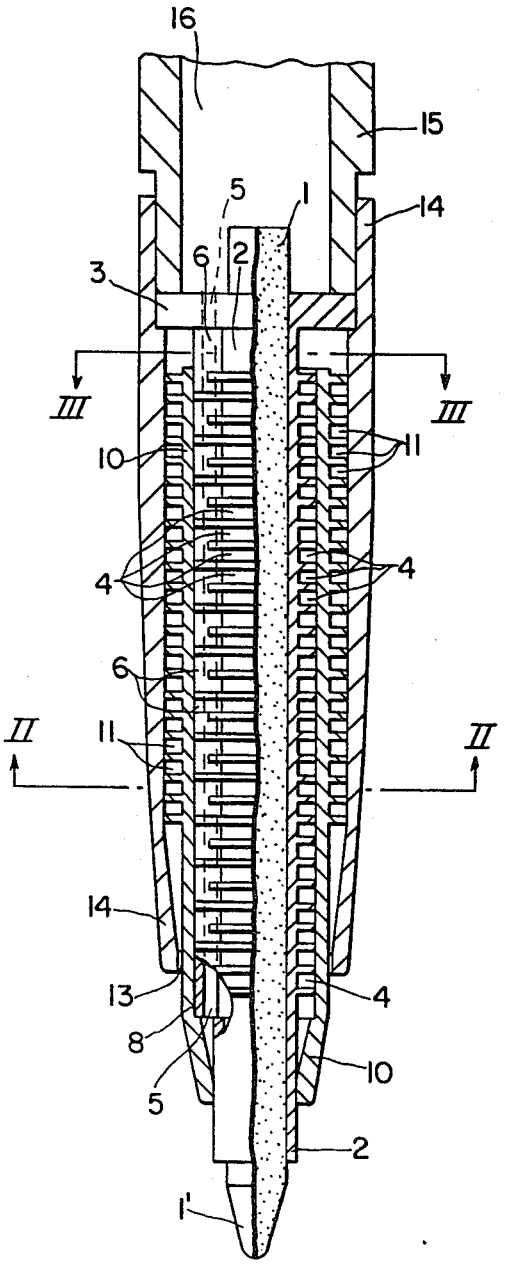
FIG. 1 is a fragmentary elevation partially in vertical section, showing a felt tip writing pen according to the present invention.

FIG. 1 shows a felt tip pen, having writing tip 1', defined at the anterior end of felt-like insert 1, to which the writing fluid, generally ink, is fed. This felt insert 1 has a circular cross-section and sits within the interior bore of a writer body 2 whereby it is in contact over nearly its entire circumference with the wall of the interior bore. At the posterior end of the writing body 2, a radially extending annular collar 3 is formed. Felt insert 1, extends rearwardly of annular collar 3, as shown in FIG. 1. The inner wall of this writing body 2, is formed, as illustrated in FIG. 1, so that there is a longitudinal groove 5, having an essentially square cross-section and exposed towards the interior bore. Groove 5 is limited by two radially extending wall sections and the tangentially extending wall section 2, as well as longitudinally extending exterior surface 8. Thus, exterior surface 8 abuts an interior surface of intermediate piece 10, described below. Radially extending vanes are provided on the peripheral surface of writing body 2, so as to form a meandering pressure equalization chamber 4. Two pairs, respectively, of longitudinal flow paths, are defined parallel to pressure equalization chamber 4 by radially extending surfaces 6 and 7, which enclose groove 5.

Figure 3:
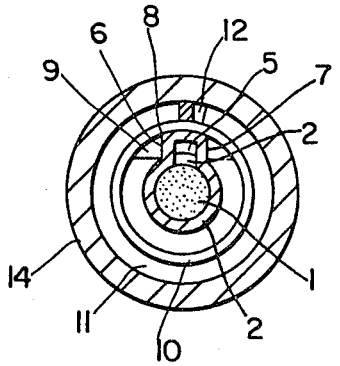
FIG. 3 is a transverse section, along line III—III of FIG. 1.

As shown in FIG. 3, one can see that the ink moves from behind the vanes partially surrounding writing body 2 and beginning at exterior surface 7 and ending shortly before exterior surface 6, so that between the exterior surface 6 and the end of the annular bore, an opening 9 is provided. The ink flows through opening 9 toward the front end to the next annular vane which is connected to the exterior surface 6 and, as indicated in the shaded area, ends shortly before the exterior surface 7, so that the ink in this area can again flow to the front to the next annular ridge which is formed similarly.

Writing body 2, containing felt insert 1, is inserted within intermediate piece 10, so that the anterior end of intermediate piece 10 makes sealing contact with writing body 2 and the interior surface of intermediate piece 10 makes sealing contact with the annular ridges forming the canals of inner pressure equalization chamber 4, as well as exterior wall surface 8.

As shown in FIG. 1, axially extending groove 5 terminates in the cavity formed between the anterior end of the intermediate piece 10 and the exterior surface of the writing body 2 and groove 5 extends rearwardly through annular collar 3.

Figure 2:
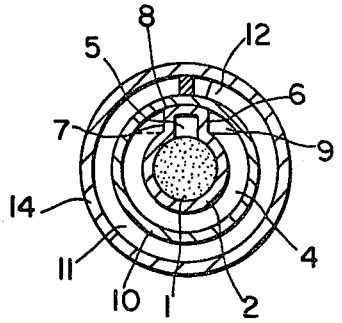
FIG. 2 is a transverse section, along line II—II of FIG. 1

Annular vanes are provided, also, on the exterior wall of intermediate piece 10, so as to form a meandering outer pressure equalization chamber 11, whereby the transition from one annular vane to the next vane, is effected in a manner similar to that described in connection with the annular vanes of inner equalization chamber 4, and by way of the intermediate chambers 12, as illustrated in FIGS. 2 and 3.

An outer sleeve part 14 abuts sealingly the annular vanes of intermediate piece 10, so that an annular cavity 13 is formed between the anterior end of sleeve 14 and the exterior wall of intermediate piece 10. This cavity connects the anterior end of outer equalization chamber 11 with ambient air. At the posterior end of sleeve 14, annular collar 3 forms a seal, so that ink reservoir 15 may be inserted from the rear into sleeve 14 and, thereby, define the ink supply chamber 16. The posterior end of felt insert 1 is supplied directly with ink from ink supply chamber 16 and, in addition, ink flows axially through the non-capillary cross-section of groove 5 to the front, so that felt insert 1 is balanced with ink along the greater part of its entire axial length, thereby assuring a constant ink supply to writing tip 1'.

When pressure increases, for example, as a result of the expansion of air within the ink supply chamber 16, due to an ambient temperature rise, ink is forced out of the anterior end of groove 5 into the anterior end of circular pressure equalization chamber 4 and may rise or flow to the rear within inner equalization chamber 4, thereby equalizing the pressure. As inner equalization chamber 4 becomes ink-filled at its posterior end, ink flows radially outwardly of chamber 4, so as to enter outer pressure equalization chamber 11, and commences flowing to the front.

In the case of low pressure, arising as a result of consumption of the ink within supply chamber 16 or as a result of ambient temperature cooling, air flows through annular cavity 13 into outer equalization chamber 11 and an air bubble may pass rearwardly through outer equalization chamber 11 and then forwardly through inner equalization chamber 4 to the front until the bubble reaches the anterior end of groove 5. The bubble may then move or climb through groove 5 to the rear without impedance and enter into the ink supply chamber 16 at the posterior end of groove 5, i.e., at the posterior surface of annular collar 3.

Of course, the felt writing device may also have the form of a tube writing pen, in which case the writing tip consists of the customary writing tube and the interior bore may contain a fall weight, reciprocating within limits in an axial direction and supporting a cleaning wire between whose exterior surface and the interior surface of the writing body a conventional capillary annular cavity is defined.

I claim:

1. A tubular writing pen of the type having a cylindrical hollow body supporting an ink reservoir at one end and a tubular felt tip pen extending from said ink reservoir through the front of said hollow body, comprising:

A. A tubular inner body having a bore that axially encompasses a longitudinally extending felt writing element extending from said ink reservoir at a posterior end to a felt tip anterior exit and defining:

i. An inner helically extending pressure equalization chamber along its outer wall and, ii. a longitudinally extending non-capillary axial passage of generally rectangular cross section along the bore wall, formed so as to prevent communication between said bore and said inner chamber along the bore, but open to said writing felt along the co-extensive interior length thereof, the tubular inner body bore and passage being uninterrupted between the posterior end and anterior opening of the writing element inner body bore, except for the passage anterior end which communicates and opens into the anterior end of said inner chamber;

B. An intermediate body complementally engaging the exterior portions of said tubular body, so as to cover said inner pressure equalization chamber, said intermediate writing body defining along its exterior wall an outer helically extending pressure equalization chamber communicant with said inner chamber at the posterior end of said chamber;

C. An outer sleeve complementally engagable with said intermediate body, so as to cover said outer equalization chamber and define at its posterior end an ink reservoir seat and so as to define at its anterior end an axial annular groove intermediate said outer sleeve and said intermediate piece, so as to communicate with ambient air; and D. An ink reservoir component complementally engagable with said outer sleeve and the posterior end of said writing body, so as to communicate with the posterior end of the writing instrument and the posterior end of said longitudinally extending axial groove.

2. A tubular writing pen as in claim 1, said tubular inner body defining at its posterior end an annular collar as a base for engagement with said reservoir and the inner wall of said outer sleeve, said annular collar having a reservoir orifice aligned with said longitudinally extending axial passage.

3. A tubular writing pen as in claim 1, wherein said writing element is a felt tip pen extensible from the ink reservoir outwardly of said writing body.

4. A tubular writing pen as in claim 3, wherein said axial groove defined in said outer wall of said inner body at its anterior end is exposed to an open annular cavity.

5. A tubular writing pen as in claim 4, wherein said annular cavity is defined by said intermediate piece anterior end.

* * * * *